United States Patent [19]

Hansen

[11] Patent Number: 4,747,505

[45] Date of Patent: May 31, 1988

[54] UNITIZED CABINET DESIGN

[75] Inventor: William G. Hansen, Clarksville, Tenn.

[73] Assignee: American Standard Inc., New York, N.Y.

[21] Appl. No.: 85,501

[22] Filed: Aug. 14, 1987

Related U.S. Application Data

[62] Division of Ser. No. 901,338, Aug. 28, 1986.

[51] Int. Cl.[4] ..... H02B 1/06

[52] U.S. Cl. ..... 220/4 R; 220/84; 62/DIG. 16

[58] Field of Search ..... 220/84, 1.5, 4 R, 4 F, 220/431, 432, 452, 468; 52/284; 62/DIG. 16; 98/31

[56] References Cited

U.S. PATENT DOCUMENTS

| | | | |
|---|---|---|---|
| 2,023,814 | 12/1935 | Lindsey | 52/284 X |
| 2,281,371 | 4/1942 | Mugler | 52/284 X |
| 2,774,808 | 12/1956 | Bullock | 220/4 R |
| 2,890,864 | 6/1959 | Stutz | 220/4 R |
| 3,710,973 | 1/1973 | Franks | 220/4 R |
| 3,832,605 | 8/1974 | Clark, Jr. | 220/4 R X |
| 4,118,083 | 10/1978 | Lackey et al. | 62/DIG. 16 X |
| 4,317,527 | 3/1982 | Belleville | 220/4 F |
| 4,400,921 | 8/1983 | Frenkel | 52/284 |
| 4,618,067 | 10/1986 | Cohn et al. | 220/1.5 |

FOREIGN PATENT DOCUMENTS

| | | | |
|---|---|---|---|
| 2159949 | 6/1973 | Fed. Rep. of Germany | 220/4 R |

*Primary Examiner*—Stephen Marcus
*Assistant Examiner*—Nova Stucker
*Attorney, Agent, or Firm*—William J. Beres; David L. Polsley; Robert J. Harter

[57] ABSTRACT

A frameless air handling enclosure is made possible by the use of double-flanged edges on the enclosure's side and bottom panels. The edge configuration provides reinforcement and rigidity to an otherwise flexible panel and also provides a mating surface for fastening the panels together. The enclosure includes an access opening that is covered by a removable access panel having a lining of sound and thermal insulating material. The access panel is installed by first sliding it upward into engagement with a top flange retainer and then sliding it back down into engagement with a bottom flange retainer. Upon engagement with both flange retainers, the lining of insulation is compressed against the perimeter of the access opening. This compression fit not only helps hold the access panel firmly in place but also provides a weathertight seal around the perimeter of the opening.

9 Claims, 4 Drawing Sheets

UNITIZED CABINET DESIGN

This is a division of application Ser. No. 901,338 filed Aug. 28, 1986.

TECHNICAL FIELD

This invention generally pertains to enclosures for large air handling equipment and specifically to a frameless enclosure with a slide-in access panel.

BACKGROUND OF THE INVENTION

Large air handling equipment such as fans, heat exchangers, and air conditioners for industrial and commercial buildings are often installed either on the roof of the building, or at ground level along the side of the building. The equipment is typically sheltered within an insulated enclosure for protection against weather and for sound dampening purposes.

Typically, the relatively large enclosures comprise several sheet metal side panels, a top cover, and a bottom panel, all mounted to a sturdy frame for support. Access to the interior of the enclosure is often by means of an access opening through one of the side panels. The opening is covered by an access panel and is reinforced with a sturdy fabricated frame to enable the access panel to be hinged and latched to the frame.

Such enclosures have several disadvantages. For example, gaskets are needed to seal the numerous joints between components of the enclosure. In addition, small moving parts such as hinges and latches on the access door are susceptible to failure due to corrosion. Another drawback is the need for a main support frame which is fairly expensive to manufacture because it is a relatively large structure constructed of heavy gauge sheet metal.

Therefore, it is an object of this invention to provide an enclosure for large air handling equipment which does not require a prefabricated frame.

Another object is to reduce the number of gaskets by having the sound and thermal insulating material also function as a gasket.

Another object is to provide an access panel that is secured with fasteners having no moving parts.

Another object is to provide an access opening which does not require a fabricated frame for rigidity.

Another object is to provide a vertical panel that can be easily adapted to function either as a bottom panel or a dividing panel.

Another object is to provide sheet metal enclosure panels having edges that can be joined in a variety of configurations.

These and other objects of the invention will be more fully understood after consideration of the following description of the preferred embodiments and the accompanying drawings.

SUMMARY OF THE INVENTION

An air handling enclosure is constructed of a plurality of interconnected, self-supporting panels. A double-flange having an L-shaped cross section is integrally formed along the perimeter of each panel. One leg of the flange extends perpendicular to and the other leg extends substantially parallel to the face of the panel.

At least one of the panels is adapted to include an access opening located between two flange retainers and defined by a frame integrally formed into the face of the panel. The access opening is covered by a removable access panel that is held in place by first sliding the access panel in one direction into sliding engagement with one flange retainer, and then sliding it back in an opposite direction into sliding engagement with another flange retainer.

DESCRIPTION OF THE PREFERRED EMBODIMENTS

Figure 1:
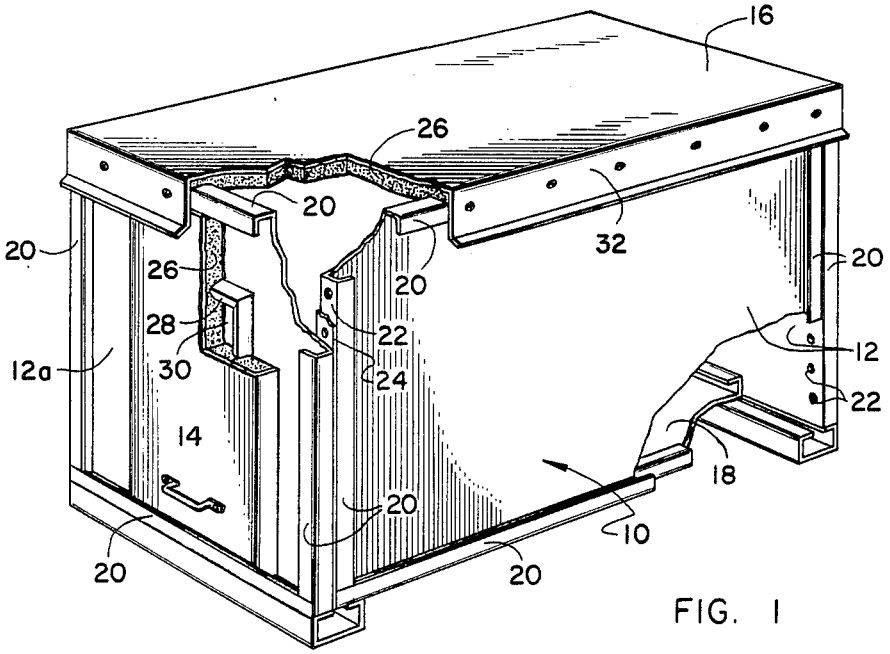
FIG. 1 is a cutaway perspective view of the enclosure.

The subject invention shown in FIG. 1 is a frameless enclosure generally denoted by reference numeral 10, for use with large air handling equipment. Enclosure 10 includes side panels 12 and 12*a*, access panel 14, top cover 16, and bottom panel 18.

Each enclosure panel 12, 12*a* and 18 is made of sheet metal and is formed to integrally include double-flanges 20 around its perimeter. Flanges 20 provide rigidity as well as define edges that are adapted to join panels 12, 12*a* and 18. These panels are held together with fasteners 22 and weather sealed with gasket 24. Fasteners 22 may be bolts, sheet metal screws, self-tapping screws, rivets or any other appropriate device. Along the top of each panel 12 and 12*a*, double-flange 20 provides a wide flat edge upon which insulation 26 disposed under cover 16 any rest without being cut, as might occur if the edge were narrow. The weight of cover 16 compresses insulation 26 against double-flange 20 to provide a weathertight seal between cover 16 and side panels 12 and 12*a*. It should be noted that insulation 26 can be selected from a variety of resilient insulating materials, such as glass wool, foam rubber, or a dual density insulation, such as "TUF-SKIN" which is a registered trademark of the Johns-Manville Corporation for a blanket-type insulation made of fine borosilicate glass fibers bonded with a thermosetting resin.

As double-flanges 20 are formed along the perimeter of side panel 12*a*, a piercing and forming operation is included to provide an integral lip 28 which defines access opening 30. Opening 30 is covered by removable access panel 14 which has a flanged edge for rigidity and a lining of insulation 26 used not only for noise dampening and thermal insulation, but also to help hold access panel 14 in place and to provide a weathertight seal.

Figure 2:
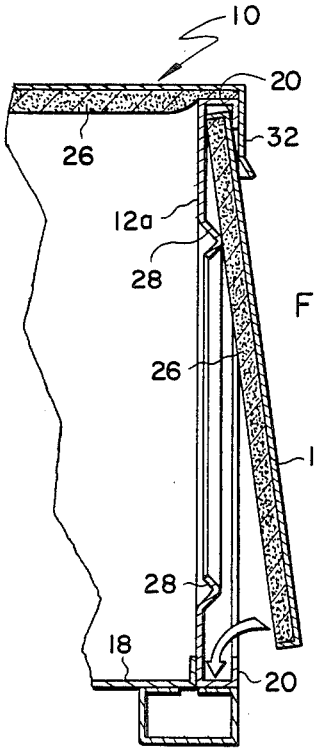
FIGS. 2 and 3 show how an access panel is installed over an access opening in the enclosure.
Figure 3:
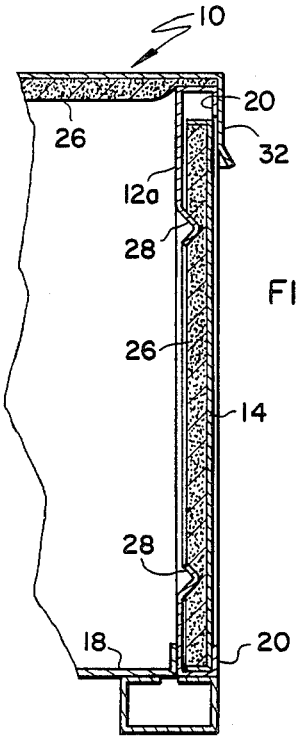

Access panel 14 is easily installed as shown in FIGS. 2 and 3. FIG. 2 shows panel 14 being lifted into sliding engagement with the upper flange retainer comprising overhanging flange 32 and upper flange 20. FIG. 3 shows access panel 14 after it has been slid back down into engagement with a lower flange retainer comprising lower double-flange 20 of side panel 12*a*. Integrally formed lip 28, pushing into resilient insulation 26, helps hold access panel 14 in place and in addition, provides a weathertight seal.

Figure 4:
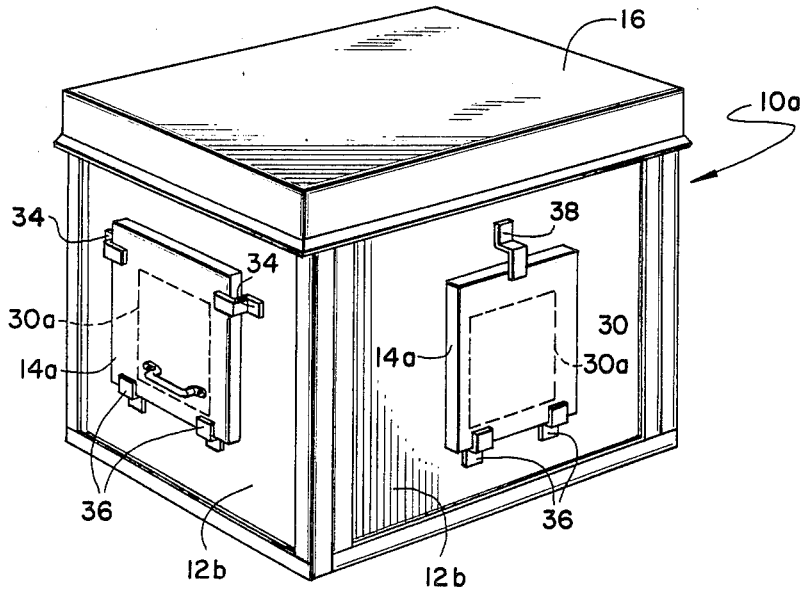
FIG. 4 shows one embodiment of the invention, wherein the height of the access panel is substantially shorter than the height of the enclosure.

Referring to FIG. 4, access panels 14*a* which do not extend the full height of enclosure 10*a* are installed by welding retaining flanges 34, 36, and 38 to side panels 12*b* near access openings 30*a*. The access panel installation procedure is similar to the procedure for installing access panel 14 of FIGS. 2 and 3. Panel 14*a* is first slid upward into sliding engagement with upper flange retainers 34 or 38 and then slid back down into engagement with lower flange retainers 36.

Figure 5:
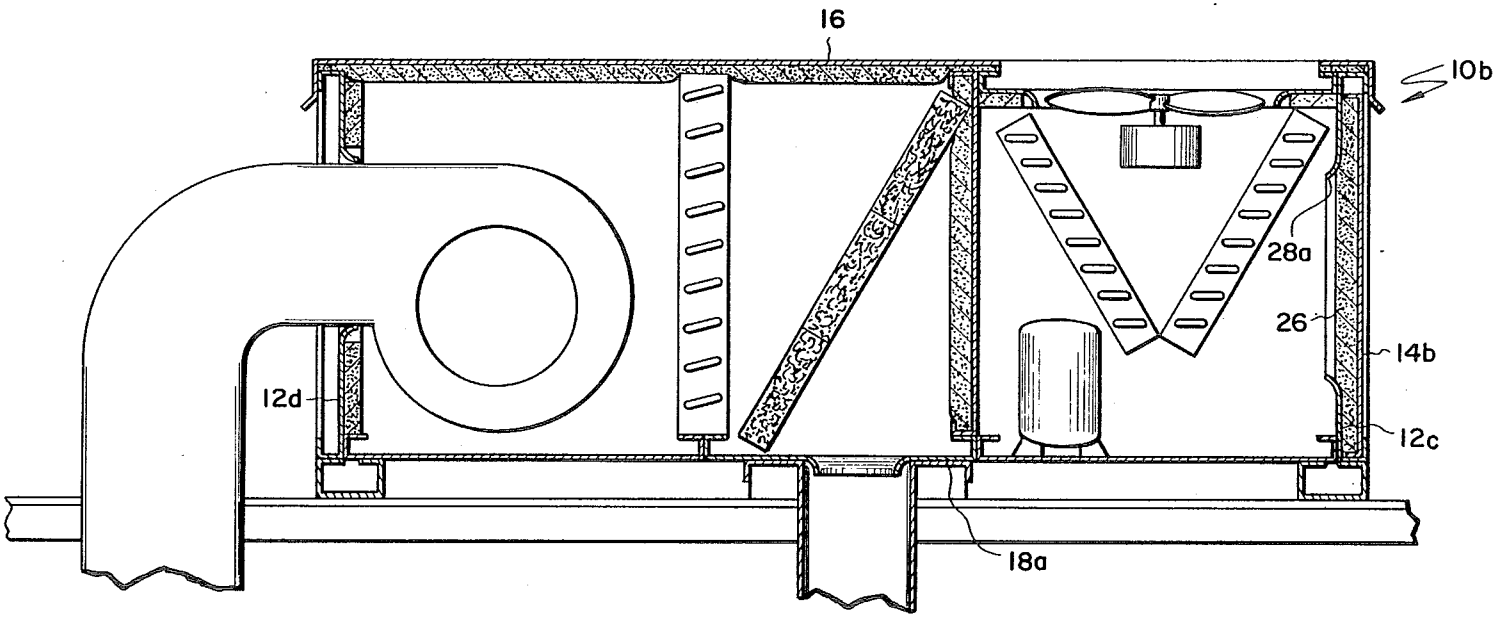
FIG. 5 is a cross sectional view of another embodiment of the enclosure.

Side panel 12*c*, shown in FIG. 5, is pierced and formed to provide an access opening and can also be used as a panel having an air duct opening, as in side panel 12*d* and bottom panel 18*a*.

Also shown in FIG. 5 is insulation 26 used to line side panel 12*d* and top cover 16. The insulation lining top cover 16 is compressed against the top of side panels 12*c* and 12*d*. In addition, lip 28*a*, formed around the access opening and extending into the interior of an enclosure 10*b*, compresses insulation 26 on access panel 14*b*, thereby providing a weathertight seal.

Figure 6:
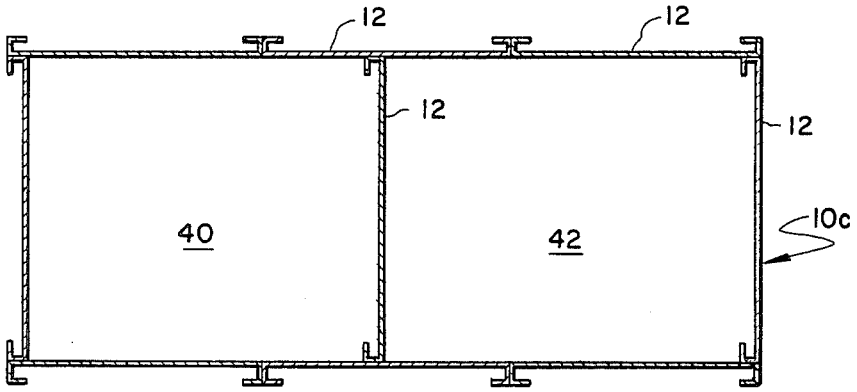
FIG. 6 is a top view schematic diagram illustrating how the side panels are interconnected to form a larger enclosure.

FIG. 6 illustrates a schematic top view of a plurality of side panels 12 interconnected end-to-end to comprise one large side panel which are then combined to form a large enclosure 10*c*. Depending on the requirements of the enclosed air handling equipment, enclosure 10*c* can be divided by a side panel 12 into two or more compartments 40 and 42.

Figure 7:
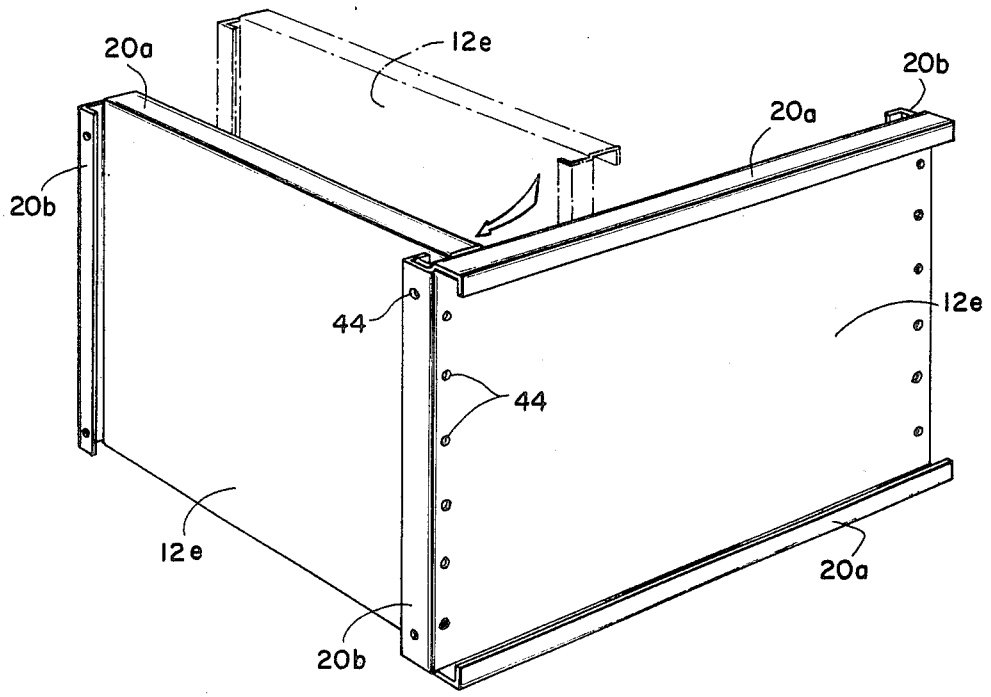
FIG. 7 is a perspective view of another embodiment showing how two side panels are joined to create a labyrinth seal.
Figure 8:
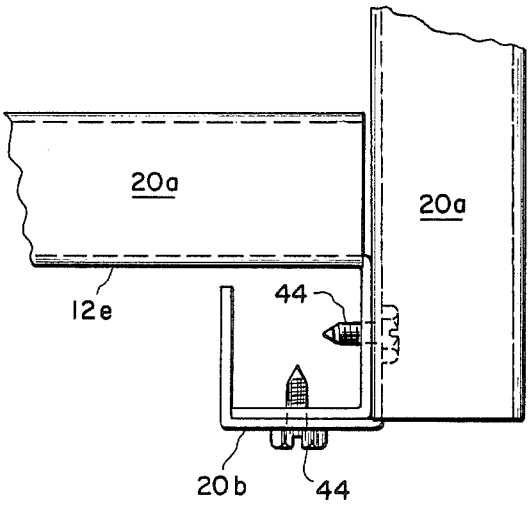
FIG. 8 is a top view of the labyrinth seal.

In another embodiment, shown in FIGS. 7 and 8, upper and lower double-flanges 20*a* extend from the face of side panel 12*e* in a direction opposite that of the other two flanges 20*b*. The assembled joint provides a labyrinth seal which can reduce or eliminate the need for gasket 24 between the joint, especially when washer-shaped gaskets (not shown) are used under the heads of fasteners 44. Appropriate fasteners for this joint are those which can be installed with access to only one side of the pieces to be joined. Examples of fasteners 44 are sheet metal screws, self-tapping screws, and poprivets.

Although the invention is described with respect to several preferred embodiments, modifications thereto will be apparent to those skilled in the art. Therefore, the scope of the invention is not limited by the preceding disclosure, and is to be determined solely by reference to the claims which follow.

I claim:

1. A frameless enclosure for air handling equipment comprising a plurality of enclosure panels each reinforced by a double-flange integrally formed along the perimeter thereof such that along a portion of the perimeter of at least one of said panels said double-flange is on only one side of said panel, and along another portion of the same perimeter said double-flange is on only the other side of said panel, said double-flange having a generally L-shaped cross-section with one leg of the flange extending substantially perpendicular to the face of said panel, and with the other leg extending from the one leg substantially parallel to the face of said panel and inward from the perimeter of said panel, said panels being interconnected to form a box-like structure that includes at least one air duct opening.

2. A frameless enclosure for air handling equipment comprising:

a. a plurality of enclosure panels each reinforced by a double-flange integrally formed along the perimeter thereof, said double-flange having a generally L-shaped cross-section with one leg of the flange extending substantially perpendicular to the face of said panel, and with the other leg extending from the one leg substantially parallel to the face of said panel and inward from the perimeter of said panel, said panels being interconnected to form a box-like structure that includes at least one air duct opening;

b. an integral lip formed into one of said enclosure panels to define an access opening therethrough;

c. a generally horizontal top cover having a downwardly extending flange disposed along its perimeter;

d. a lining of insulation underneath said top cover to provide a compression seal where said top cover overlies a top edge of at least one of said enclosure panels; and e. an access panel covering said access opening and held in place upon engagement with said downwardly extending flange of the top cover and at least one double-flange of said enclosure panels.

3. The frameless enclosure as recited in claim 2, wherein said access panel includes a lining of insulation which provides a compression seal against the lip defining said access opening.

4. A frameless enclosure for air handling equipment, comprising:

a. a quadrilateral bottom panel having a double-flange integrally formed along its perimeter, wherein said double-flange includes a first and a second flange with said first flange being disposed along the perimeter of said bottom panel and extending substantially vertically therefrom and with said second flange being disposed along the distal edge of said first flange and extending inwardly away from the perimeter of said bottom panel;

b. a plurality of substantially vertical and rectangular side panels, each having a double-flange integrally formed along its perimeter such that for a portion of the perimeter of at least one of said side panels said double-flange is on only one side of said panel, and along another portion of the same perimeter said double flange is on only the other side of said panel, said double flange having a first and a second flange with said first flange disposed along the perimeter of each of said side panels and extending substantially perpendicular therefrom and with said second flange disposed along the distal edge of said first flange and extending inward away from the perimeter of each of said side panels, wherein the vertical edges of said side panels are fastened together and the bottom edge of each of said side panels are fastened to the perimeter of said bottom panel, whereby said plurality of side panels and said bottom panel are assembled into a box-like structure; and c. a generally horizontal top cover having a downwardly extending flange disposed along the perimeter thereof, wherein said top cover fits over the top of said box-like structure.

5. A frameless enclosure for air handling equipment, comprising:

a. a quadrilateral bottom panel having a double-flange integrally formed along its perimeter, wherein said double-flange includes a first and a second flange with said first flange being disposed along the perimeter of said bottom panel and extending substantially vertically therefrom and with said second flange being disposed along the distal edge of said first flange and extending inwardly away from the perimeter of said bottom panel;

b. a plurality of substantially vertical and rectangular side panels, each having a double-flange intergrally formed along its perimeter, wherein said double-flange includes a first and a second flange with said first flange disposed along the perimeter of each of said side panels and extending substantially perpendicular therefrom and with said second flange disposed along the distal edge of said first flange and extending inward away from the perimeter of each of said side panels, wherein the vertical edges of said side panels are fastened together and the bottom edge of each of said side panels are fastened to the perimeter of said bottom panel, whereby said plurality of side panels and said bottom panel are assembled into a box-shape structure; and c. a generally horizontal top cover having a downwardly extending flange disposed along the perimeter thereof, wherein said top cover fits over the top of said box-shape structure.

d. an integral lip formed into one of said side panels to define an access opening therethrough; and e. an access panel covering said access opening and held in place by engagement with said downwardly extending flange on the top cover and at least one double-flange of said side panels.

6. The frameless enclosure as recited in claim 5, wherein the underside of said top cover includes a lining of insulation that provides a compression seal between said top cover and the top edge of each of said side panels.

7. The frameless enclosure as recited in claim 5, wherein said access panel includes a lining of insulation which provides a compression seal against said lip.

8. A frameless enclosure comprising:

a. at least two sheet metal panels each reinforced by a double-flange integrally formed along the perimeter of each of said panels, said double-flange having a generally L-shape cross-section with one leg of the flange extending generally perpendicular to the face of its panel and with the other leg extending from the one leg generally parallel to the face of its panel and inward from the perimeter of its panel, said panels being interconnected to form a box-like structure;

b. a seamless lip integrally formed in at least one of said panels to define at least two generally rectangular air duct openings through said box-like structure;

c. a fan disposed inside said enclosure for conveying air through said enclosure between said air duct openings;

d. insulation lining the interior of said enclosure for providing sound absorption and heat insulation; and e. a generally horizontal top cover having a downwardly extending flange disposed along the perimeter thereof, said cover being adapted to fit over the top of said box-like structure.

9. The frameless enclosure as recited in claim 8, wherein the underside of said top cover includes a lining of insulation that provides a compressive seal between said top cover and the top edge of each of said side panels.

* * * * *